US005996266A

United States Patent [19]

Orozco

[11] Patent Number: 5,996,266

[45] Date of Patent: Dec. 7, 1999

[54] MECHANISM FOR A SEMIAUTOMATIC SUBMACHINE GUN

[76] Inventor: Hector Mendoza Orozco, Fuego 986, Colonia Jardines del Pedregal, Alvaro Obregón, Federal Districk, Mexico

[21] Appl. No.: 09/050,654

[22] Filed: Mar. 30, 1998

[51] Int. Cl.[6] ..... F41A 17/22

[52] U.S. Cl. ..... 42/70.04; 42/70.05; 42/70.06; 42/70.08; 89/154

[58] Field of Search ..... 42/70.06, 70.02, 42/70.08, 70.04, 70.05; 89/142, 148, 154

[56] References Cited

U.S. PATENT DOCUMENTS

| | | | |
|---|---|---|---|
| 1,143,471 | 6/1915 | Whiting | 89/148 |
| 2,846,925 | 8/1958 | Norman | 89/148 |
| 4,589,327 | 5/1986 | Smith | 89/148 |
| 4,833,970 | 5/1989 | Wilhelm | 89/142 |

FOREIGN PATENT DOCUMENTS

| | | | |
|---|---|---|---|
| 662662 | 8/1929 | France | 42/70.02 |
| 660046 | 10/1951 | United Kingdom | 42/70.08 |

*Primary Examiner*—Stephen M. Johnson
*Attorney, Agent, or Firm*—Harrison & Egbert

[57] ABSTRACT

An improved mechanism for a semiautomatic submachine gun having a trigger, a spring box connected to the trigger, a ring connected to the trigger and moveable in a linear manner, a plate with a safety lever mounted thereon, a double-looped spring received by the plate, a retained lever providing a stop for the safety lever, a double-looped spring mounted on the bolt of the retained lever, a hammer corresponding to a cut-out formed in the retained lever, a spring clasped to the hammer to retain the hammer in a fixed position, and a carriage automatically moveable backwards after a cartridge has been fired.

6 Claims, 9 Drawing Sheets

MECHANISM FOR A SEMIAUTOMATIC SUBMACHINE GUN

TECHNICAL FIELD

The present invention relates to semiautomatic submachine guns. More particularly, the present invention relates to the firing mechanisms of such submachine guns.

OBJECTS OF THE INVENTION

This invention concerns a new model of an improved semiautomatic submachine gun whose main purpose is that of being made up of a reduced number of parts, having low assembly costs, being easy to operate and of offering a shot pattern.

One of the objectives of this invention is offer a safe and reliable mechanism, which can be shot only if the permanent safety lever is released. The safety device comprises a lever which is located towards the back part of the lodging of the magazine Another purpose of this invention is to offer a safe firearm since the shooting safety bolt prevents the discharge of a shot when the firearm is accidentally dropped.

Another aim of this invention is to offer a reduced number of parts, which does not imply any limit in its operation or a reduction in precision or shot pattern.

Another objective of this invention comprises a simplified design of parts, which allows disassembling and verification of all its components either for cleaning purposes or periodic repair.

Another purpose of this invention is to offer an effective mechanism which avoids the mobile parts from jamming. Therefore we can guarantee that it is a reliable firearm.

Another goal of this invention is to offer a roller located over the hammer, whose purpose is to avoid friction of the slipper against the hammer and to smoothly prepare the hammer for the next shot.

Additionally, the mechanism has a closed-bolt design which avoids the movement of the carriage or slipper. Therefore, shooting at the target is done in a steady manner and with only a slight movement, which is important for the firearm's precision.

BACKGROUND OF THE INVENTION

Most semiautomatic submachine guns operate by pressing the trigger, which entails a large number of mechanical parts and gauged springs, and various types of safety devices or levers in order to operate the firearm semiautomatically.

In all cases the ammunition feed is done manually through a prebuilt magazine which is adapted to each type of firearm. Once the firearm is shot, the shells are first extracted by a mechanism which is adapted above the carriage or slipper of the firearm and then expelled by means of a plate when the carriage retracts.

It is understood that in case the firearm need be fired, it will have to be unprotected by the safety device or in the position desired for use. And sometimes when the owner accidentally drops the firearm it goes off due to the sensitive mechanism which it possesses. Since this activity is very risky, the safety device must be on.

This can be a very dangerous task for the owner because while he is searching for the device with his fingers, he is being distracted from the objective. Likewise, the task can be unsafe due to lost time that it entails.

To outweigh these inconveniences a semiautomatic submachine gun with a permanent safety device has been designed. Said device is disactivated when pressed by the long extensor of the hand, in order to consequently pull the trigger.

This safety device features a spring whose purpose is to bring back the safety device to its original position and it will only be disactivated when the firearm is used again. This task is simpler, easier and quicker in comparison with other types of safety devices found on conventional submachine guns. These have a positional safety device that can be moved with the thumb or any other finger.

On the other hand, the simplified mechanism is adapted to a closed-bolt. In other words, one where the carriage or slipper is located towards the front and ready for firing, which differs from the open-bolt type in which the carriage or slipper is located towards the back.

This observation is quite relevant as far as the precision of the firearm is concerned, because in different submachine guns the slipper moves forward and this causes a movement throughout the firearm, which in turn diminishes its precision. Whereas in this particular case the mechanism has been simplified. Since it features a closed-bolt and it has been designed to notably diminish the movement of the carriage or slipper, shooting at a target is done in a steady manner.

DETAILED DESCRIPTION OF THE INVENTION

Figure 3:
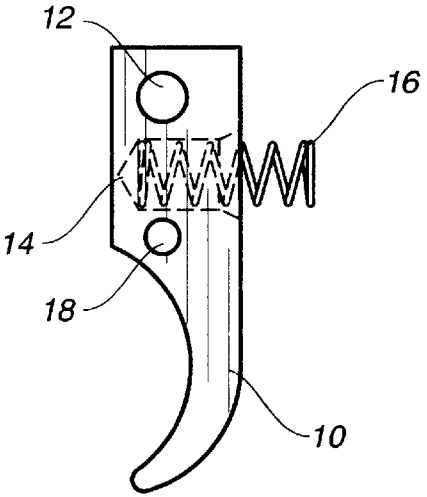
FIG. 3 is another view of the trigger along with its spring, set in a normal position ready to fire.
Figure 5:
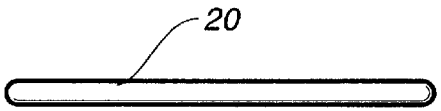
FIG. 5 is another view of the elongated rectangular ring.
Figure 2:
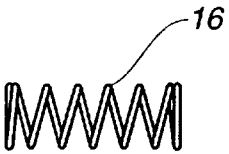
FIG. 2 is a view of the spring that will be set inside the trigger.
Figure 4:
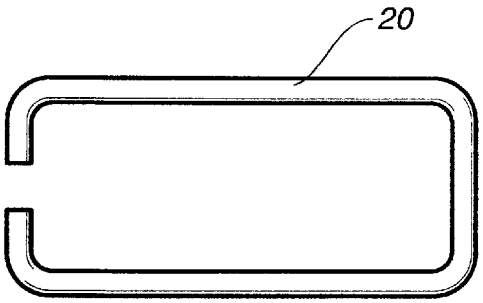
FIG. 4 is a view of an elongated rectangular ring.
Figure 1:
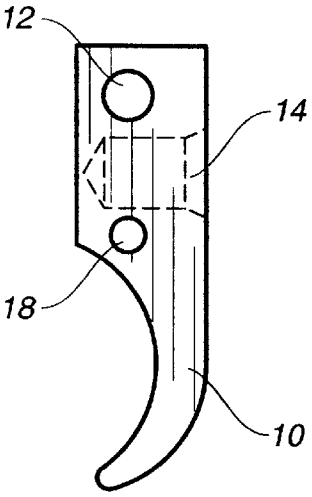
FIG. 1 is a sectional view of the trigger.
Figure 7:
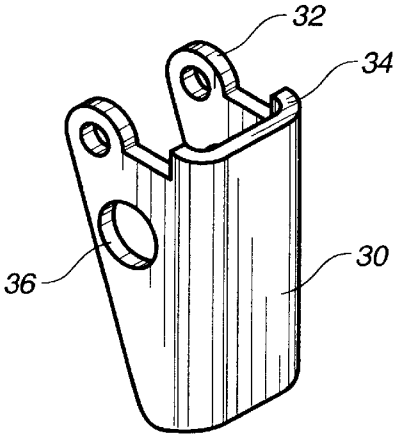
FIG. 7 is a conventional perspective of the trigger's safety device.
Figure 9:
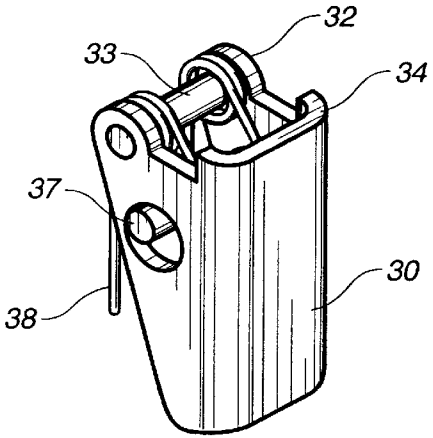
FIG. 9 is a conventional perspective of the trigger's safety device along with the spring and the limiting bolt.
Figure 6:
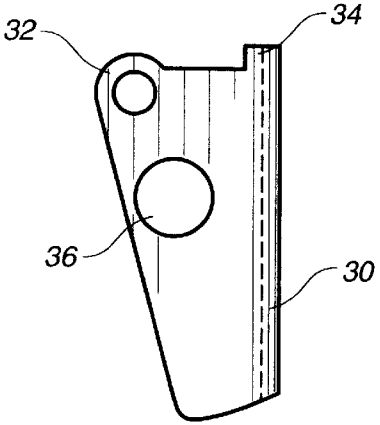
FIG. 6 is a view of the lever that constitutes the safety device of the trigger.
Figure 8:
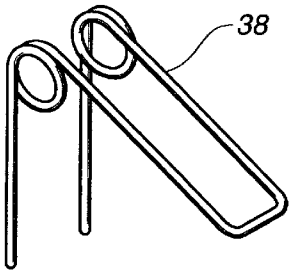
FIG. 8 is a view of the spring of the trigger's safety device.
Figure 11:
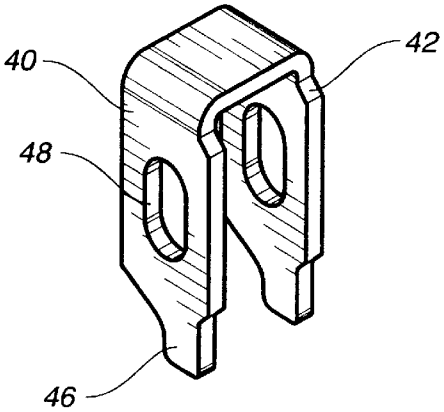
FIG. 11 is a conventional perspective of the retained lever.
Figure 13:
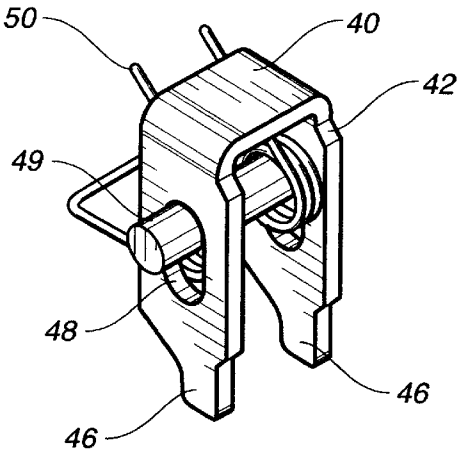
FIG. 13 is another perspective of the retained lever along with the spring and the guide bolt upon which the retained lever revolves.
Figure 10:
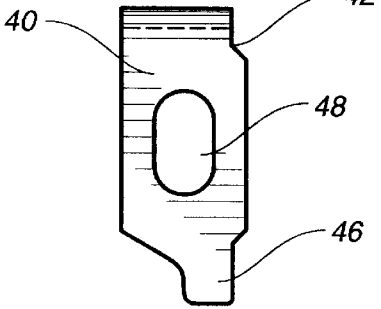
FIG. 10 is a view of the retained lever.
Figure 12:
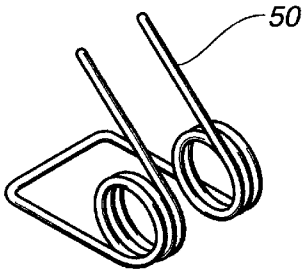
FIG. 12 is a perspective of the spring of the retained lever.
Figure 15:
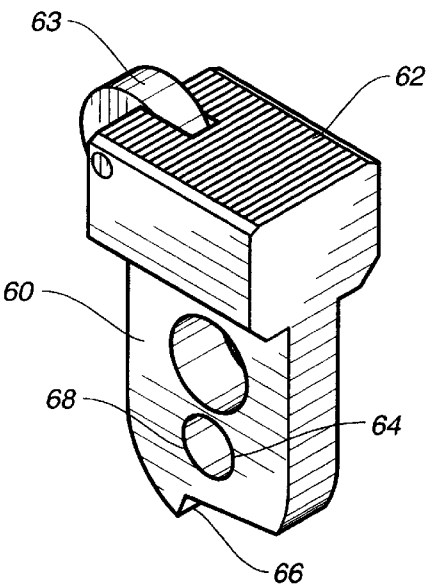
FIG. 15 is a conventional perspective of the hammer.
Figure 17:
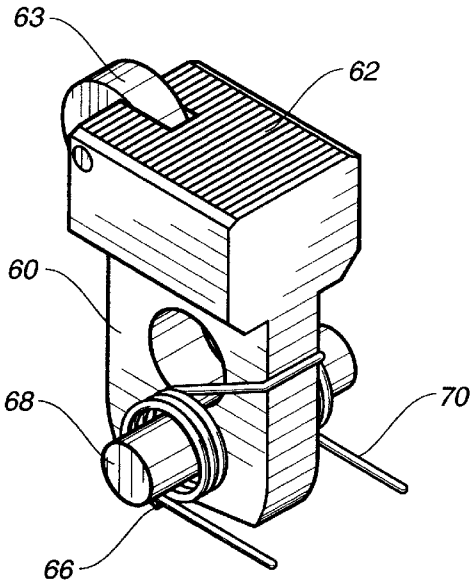
FIG. 17 is a general view of the hammer along with the spring and the hammer's bolt.
Figure 14:
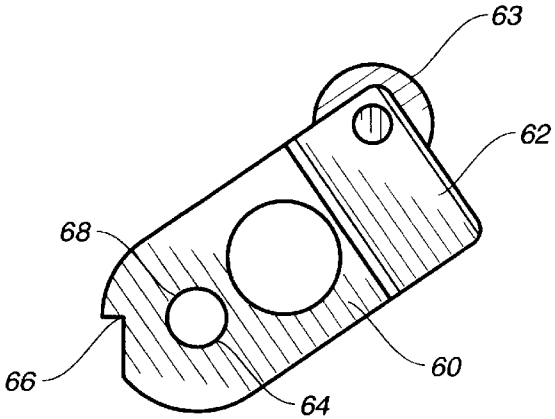
FIG. 14 is a view of the hammer of the submachine gun.
Figure 16:
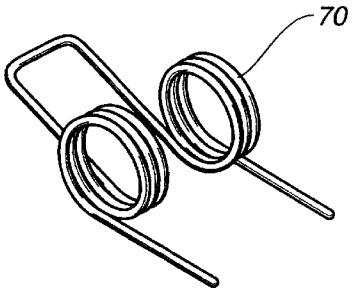
FIG. 16 is a view of the hammer's spring.

In reference to the above mentioned figures, the semiautomatic submachine gun of this particular invention consists of:

A trigger 10 made up of a rectangular shaped body, with an appendage on its lower section. The latter is curved towards one side in order to be grasped by the index finger. On the upper section there is a hole 12 through which an axle bolt of the trigger 10 will go, and will serve as a swivel for the movement of the trigger, and it is fixed upon the body of the firearm. This is an advantage because the size of the trigger 10 is reduced, and there is no need for additional supports or levers.

Towards the middle of the trigger 10 there is a longitudinal hole which forms a box 14 in which a spring 16 will be installed. The purpose of the latter is to keep the trigger in a vertical position, and after the firearm has been shot, return the trigger, through pressure, to its normal position, hence, ready for the next shot.

Below the spring box 14 there is another transversal hole 18, where an elongated ring 20 will be set. The ring has a rectangular shape and is adapted to the shape of the magazine receptacle. It moves in a linear manner when the trigger 10 is pressed and its purpose includes pushing a lever.

Towards the opposite side of the buttstock there is a chute 31 that has two transversal holes and which is fixed on the magazine receptacle 90. A plate 30*a* is formed on a side of the magazine receptacle 90.

The lever which makes up the trigger's safety device 30 has a rectangular chute form, sticking out downwards in a triangular or wedge form. The safety device is secured to plate 30*a* of the magazine receptacle 90. Its edges are rounded and has lobes 32 on the extreme top side. It also has some holes which coincide with the upper holes of the chute 31. Therefore the safety device of the trigger 30 is attached by means of a bolt 33.

The trigger's safety device 30 has a projection or border 34 towards the opposite extreme top side; its purpose is to precisely secure the firearm so that it doesn't go off unless the safety device is moved from its position.

Towards the middle of the trigger's safety device 30 there is an eyelet 36 which limits the course of the safety device by means of a bolt 37, which is set in the lower hole of the chute 31. Hence, the trigger's safety device 30 will move in a limited fashion.

A spring 38 is used to keep the trigger's safety device 30 precisely in a secure position. The double loop spring is kept in place by the bolt 33, one of its tips against the bolt 37 and the other tip against the base of the chute 31. This trigger safety device 30 may be released through the pressure of the long extensor of the hand and it will return to its original posit-on once the pressure is discontinued, whereupon the spring 38 is operated.

A retained lever 40 which comprises a rectangular plate in the shape of a fork and has some oval holes 48 on its sides. These allow a forward inclination and the upward movement of said part. It also has a bolt 49 mounted on the body of the firearm, which serves as an axis so that the lever may carry out the specified operations.

A double loop spring 50 is mounted on the bolt 49 in such a manner that one tip is pressed against the structure of the upper part of the retained lever 40 and the other tip over the loading hole 91 of the magazine receptacle 90.

The purpose of this double loop spring 50 is to continually push the retained lever 40 towards the hammer's rest 66.

This retained lever 40 sticks out, in its upper tip, from a small cutting 42 and has a specific function of acting as a safety device. It rests upon the hammer 66 of the niece that presses against the firing needle 80 and which is described later.

Towards the lower part of the retained lever 40 there is a projection 46, which actually is correlative to the projection or border 34. Therefore, it does not allow the movement of the ring 20 of the trigger 10.

There is also an inclined cutting towards the opposite side of the projection 46. When the elongated ring 20 touches said part it will make it retract due to the inclination and will smoothly return the ring 20 and the trigger 10 to their original positions.

A hammer 60 consisting of a piece of a cylindrical shaped body and whose head sticks out in a rectangular form and whose body has two holes. The first of these holes diminishes the weight and therefore the pressure against the firing needle is greater. The second, a central hole 64, supports a fastening bolt 68 which is located towards the inside of the firearm. The head 62 of the hammer moves from its body 60. Its tip is rectangular and its function is to exert great pressure against the firing needle 80, hence allowing the firearm to shoot. The head of the hammer 60 has a small notch 66 located towards the lower part of the rectangular part and it coincides over the small cutting 42 of the retained lever 40, which in turn prevents the movement of the hammer 60 against the firing needle 80.

This hammer 60 remains in a fixed position and ready to hit against the firing needle 80, and is clasped by a spring 70, with many loops.

In order to make the inspection or repair of the firearm, easier, the top surface of the head 62 of the hammer has been scraped or knurled. Therefore, it will be easier to pull the hammer 60 with the thumb.

A cartridge 82, which automatically moves backwards after cartridge has been fired, is of the closed-bolt type. It pushes the hammer 60 backwards with a cutting 84.

Therefore, when the carriage 82 returns to its original position, the hammer 60 will retract to a slightly higher position than the original one, in order to rest through the notch 66 in combination with the cutting 42 by means of the operation of the spring 50 of the retained lever. This in turn forces it descend to a normal position. Consequently, the projection 46 will coincide with the stop 34, for it subsequent fastening.

The movement of the carriage 82 over the hammer 60 is smooth due to the roller 63, which will initially turn as it touches the carriage 82 and will continue to move pushing the head 62 of the hammer until it reaches a slightly higher position than the original one. Consequently, when the carriage 82 returns the hammer 60 will turn around Lo rest upon the cutting 42.

Operating the trigger is very simple.

The firearm is grasped by the magazine lodging and the index finger is held against the trigger 10. Simultaneously, the long extensor or joint of the hand will sustain the lever or safety device 30 and will push it forward. Consequently, it will be disactivated and the cutting or wedge 46 of the retained lever 40 will be freed.

The spring of the retained plate 50 will operate leaving the retained lever 40 in a steady position.

Figure 18:
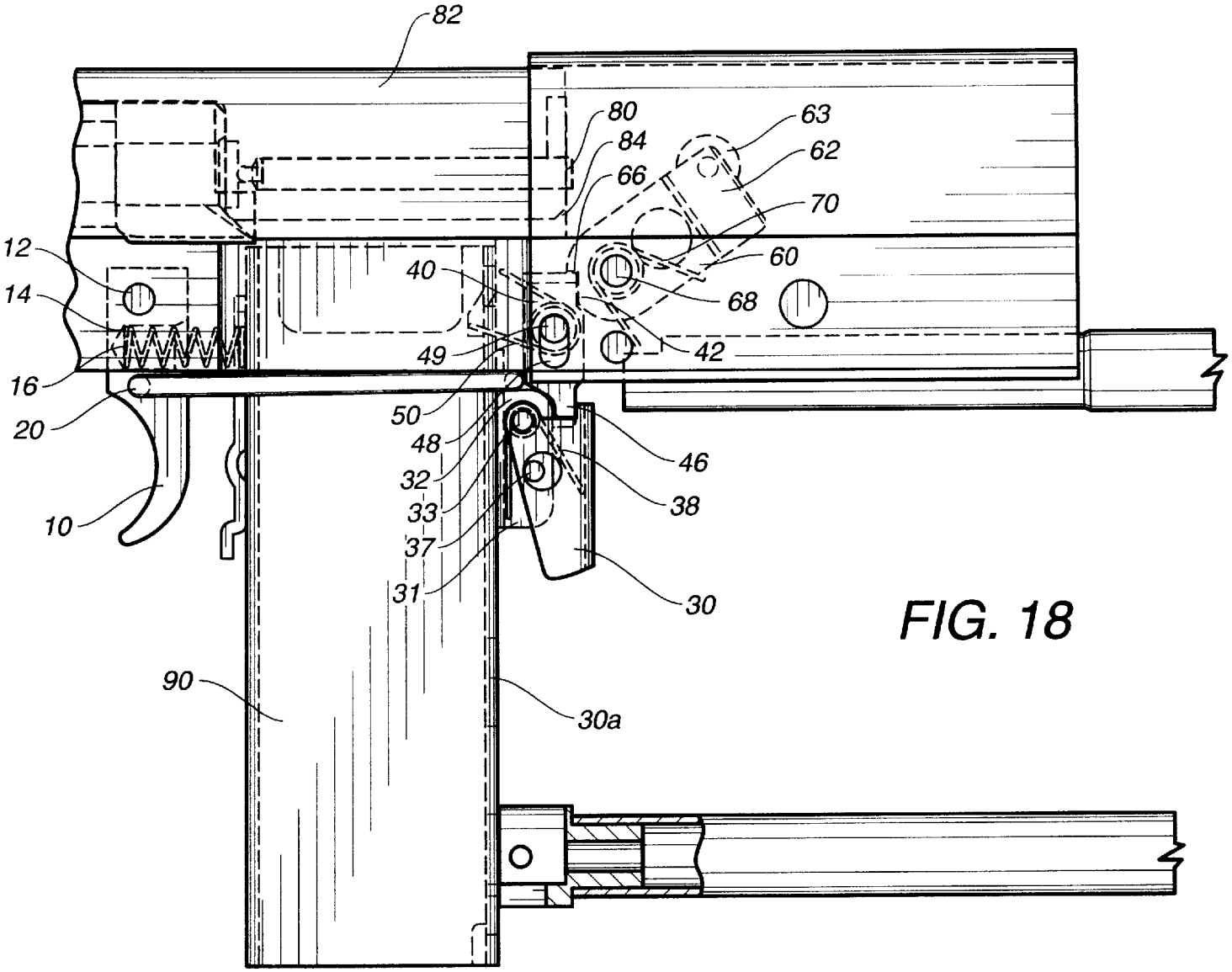
FIG. 18 is a side view the assembled invention, where one can contemplate the assembled hammer.
Figure 18A:
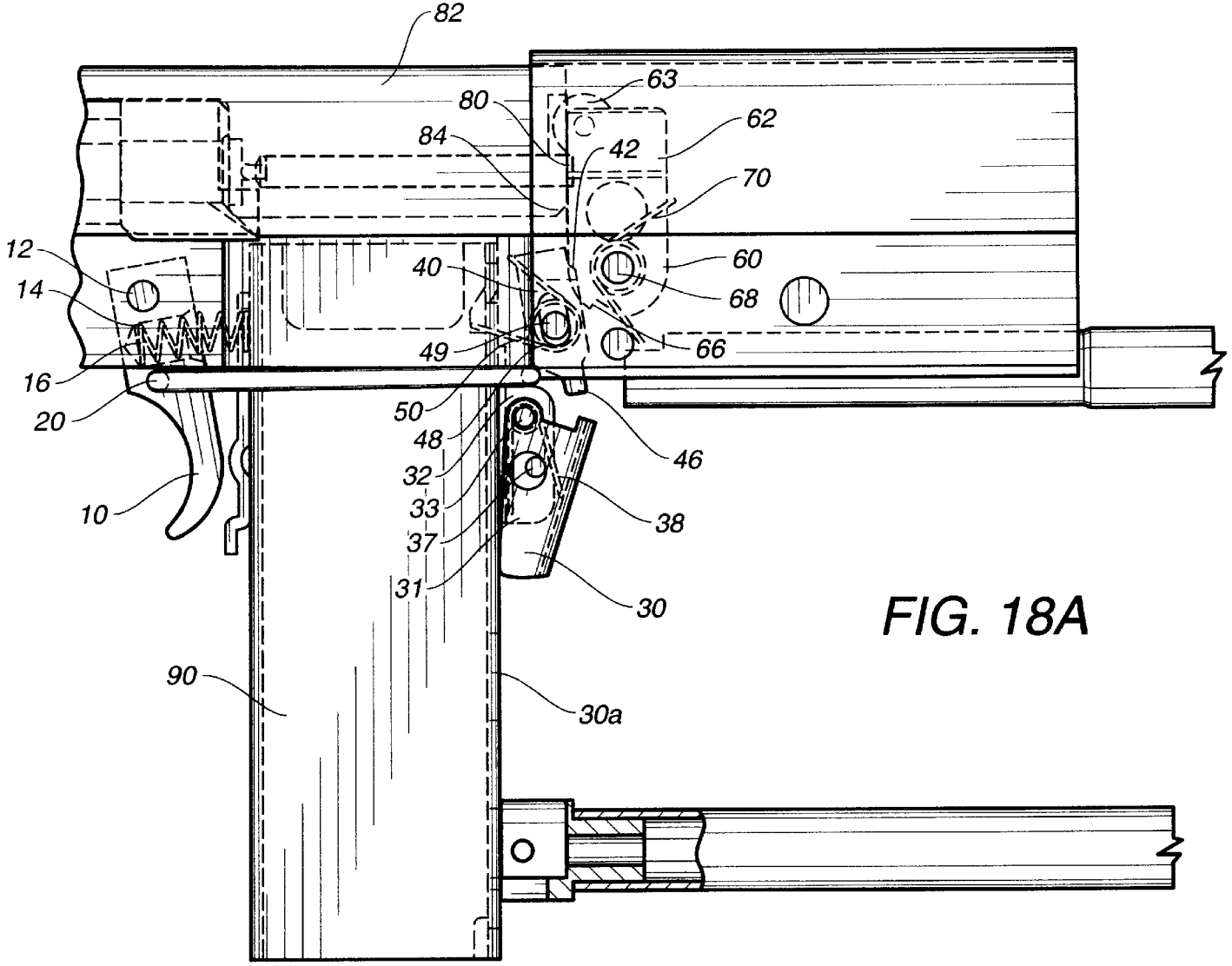
FIG. 18A is another s de view of the assembled invention with the hammer completely lowered by the carriage or slipper, and once the latter returns to its closed position, the hammer will be in a firing position.

Once the trigger 10 (FIG. 18A) is pressed, the elongated ring 20 will move backwards in a linear manner and will hit against the inclined cutting of the retained lever 40 forcing it to revolve backwards over the bolt 49, therefore rising slightly.

At that moment the cutting 42 of the retained lever 40 will release the notch 66 of the hammer 60 hitting against the firing needle 80. Consequently a cartridge will be detonated.

Figure 18B:
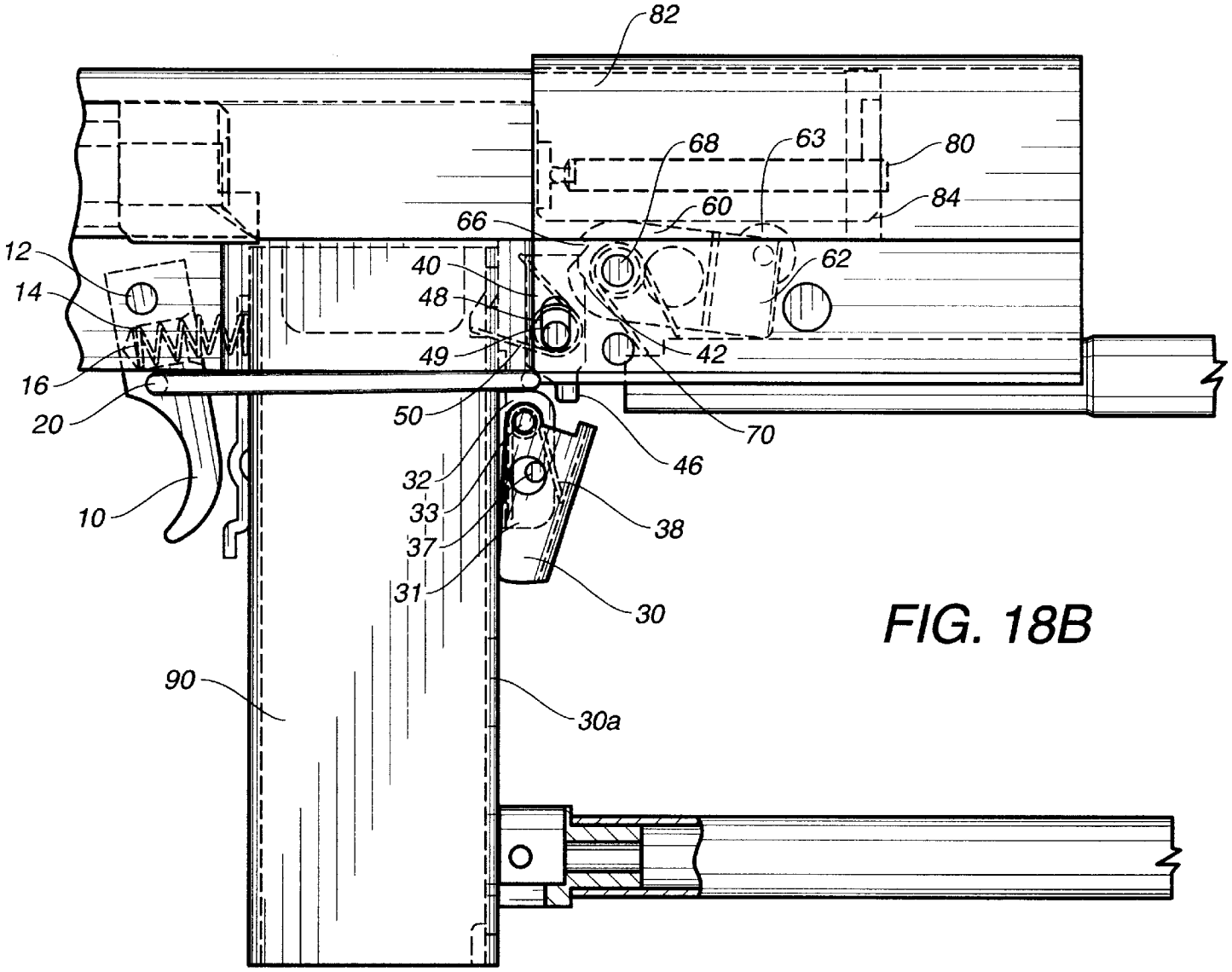
FIG. 18B is another side view of the assembled invention which shows the backward movement operation of the carriage which rests upon the roller. One can also see the manner in which the hammer returns to its original position.

Once the firearm has been fired, the carriage 82 (FIG. 18B) will move backwards to extract the shell, and as it moves it will expel the shell through a plate. As it reaches the end of its course it will gently push, by means of the cutting 84, the roller 63. As this roller 63 turns it will exert pressure against the hammer 60, which will move backwards. Simultaneously, another cartridge will rise to the magazine.

Figure 18C:
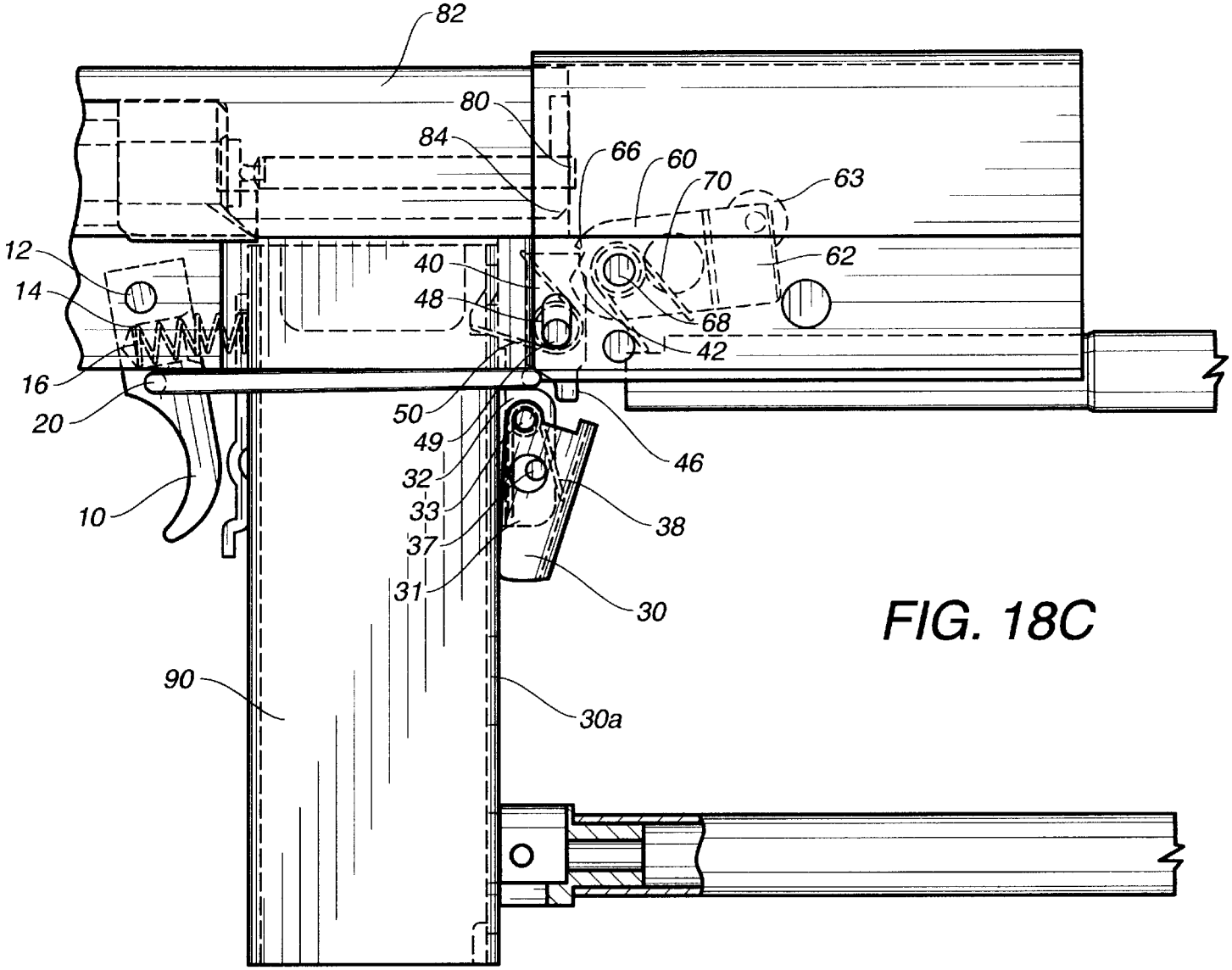
FIG. 18C is another side view of the assembled invention showing how the hammer would look along with the retained lever, the safety device of the trigger and of course with the trigger pulled back.
Figure 19:
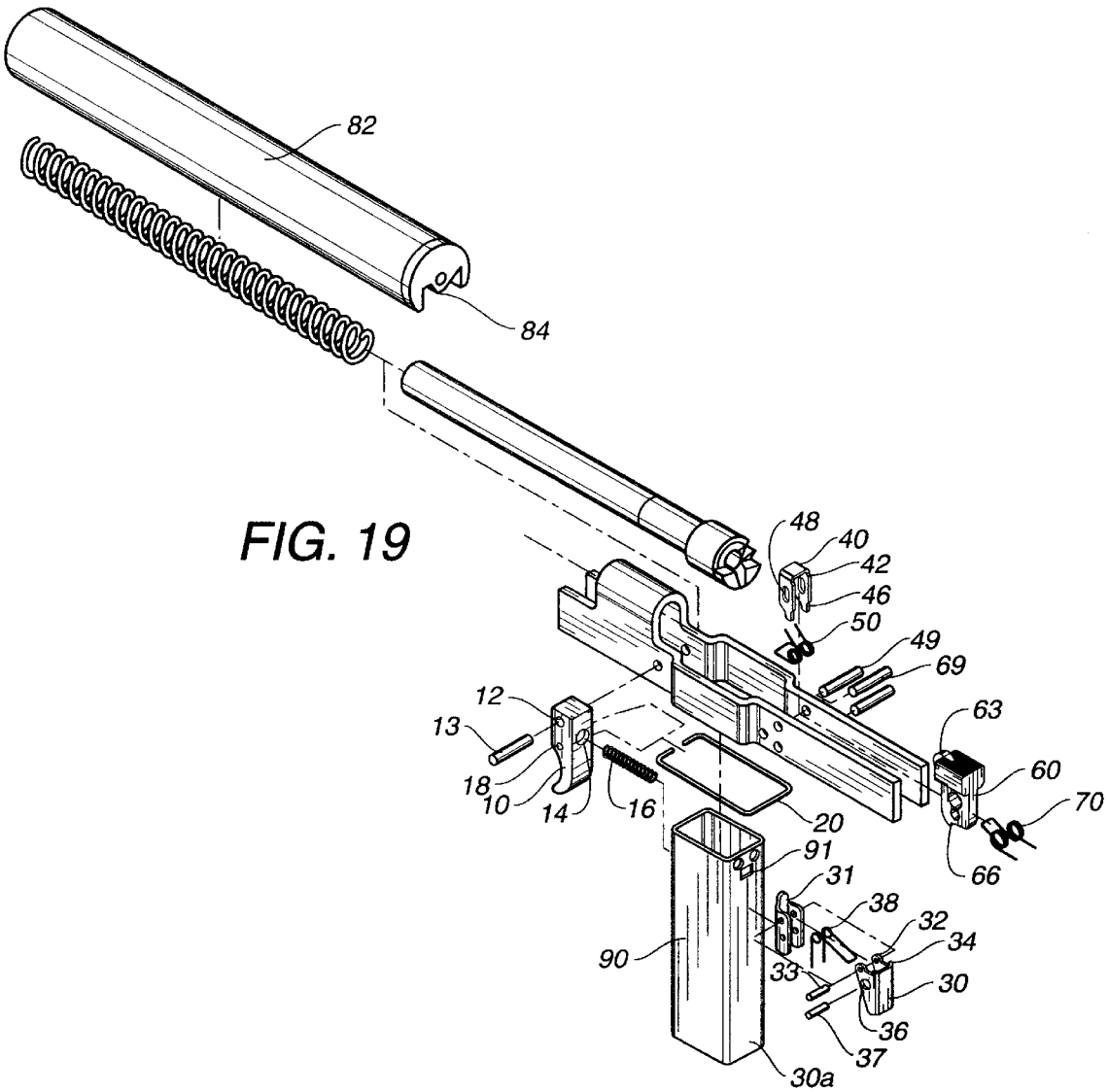
FIG. 19 is a conventional view of the disassembled invention.

When the carriage 82 (FIG. 18C) returns the simplified mechanism is a closed-bolt. In other words, it is set towards the front and ready for firing.

Then the hammer 60 will have a slight inclination and the cutting 66 will coincide and supported upon the cutting 42, helped by the spring 50 of the retained plate 40, with such strength that the retained plate 40 will be set vertically and will rest upon the elongated ring 20 with the slanted plane.

The trigger 10 (FIG. 18) will have to move slightly to the front, dragging the elongated ring 20, whereupon the retained plate 40 will reach its original position.

When the trigger 10 is once again pulled, the above mentioned operations will be repeated.

I claim:

1. An improved mechanism for a semiautomatic submachine gun comprising:

a trigger having a rectangular shaped body with an appendage on its lower section, the appendage being curved towards one side, on an upper section of said trigger is formed a hole through which an axle bolt of the trigger passes, a spring box in which a spring is installed is formed in a middle of the rectangular-shaped body and adapted to keep said trigger in a vertical position and to return the trigger after use, the trigger has a second hole in which an elongated ring is set, the elongated ring has a rectangular shape and is adapted to extend around a magazine receptacle, said ring movable in a linear manner when the trigger is pressed so as to push a retained lever;

a plate is formed on the magazine receptacle, a safety lever is mounted onto said plate, said safety lever contains a rectangular-shaped chute and sticks out downwards in a generally triangular form, said safety lever having edges which are rounded and having lobes on a top side, a transversal hole extends through said lobes through which the safety lever is articulated by means of a bolt, the chute has a projection towards an opposite top side such that the safety lever is resiliently retained in a vertical position;

a double-looped spring having spirals that are kept in place by said bolt set in the lobes of the safety lever;

said retained lever being a rectangular plate of a fork shape, said retained lever having oval holes on sides thereof, said retained lever having a bolt mounted on an inside of the firearm which is an axis for the retained lever, said retained lever having a wedge located towards a lower portion and which acts as a stop to a movement of the safety lever;

another double loop spring mounted on the bolt of the retained lever in such a manner that one end of said another double loop spring is pressed against an upper portion of the retained lever and another end extends over the magazine receptacle, a projection is formed on said lower portion of said retained lever;

a hammer having a cylindrically shaped portion and a body with two holes, one of the two holes supports a fastening bolt which is located at an inside of the firearm, said hammer has a head of rectangular shape, the head is movable from one end of the body of the hammer, said hammer has a notch located at a lower portion of the body of the hammer and coincides over a cut-out portion of the retained lever;

a spring with multiple loops is clasped to the hammer so as to retain said hammer in a fixed position; and a carriage adapted to move automatically backwards over said magazine receptacle after a cartridge has been fired.

2. The improved mechanism of claim 1, said axle bolt being adapted to allow a pendular movement of said trigger.

3. The improved mechanism claim 1, wherein the safety lever, the retained lever and the hammer are articulated so as to form a safety device of the firearm.

4. The improved mechanism of claim 1, wherein an eyelet of the safety lever along with the bolt mounted on the plate are adapted to, limit the movement of the safety lever.

5. The improved mechanism of claim 1, wherein the holes of the retained lever and the bolt of the retained lever are adapted to allow the retained lever to turn over the bolt of the retained lever and simultaneously move upwards.

6. The improved mechanism of claim 1, wherein the double loop spring mounted on the bolt of the retained lever is adapted to force the retained lever to remain in a downward position.

* * * * *